US005511355A

United States Patent [19]

Dingler

[11] Patent Number: 5,511,355

[45] Date of Patent: Apr. 30, 1996

[54] CONSTRUCTION ELEMENT

[76] Inventor: Gerhard Dingler, Industriestr., W-7472 Haiterbach, Germany

[21] Appl. No.: 864,105

[22] Filed: Apr. 6, 1992

[51] Int. Cl.[6] ..... E04C 3/29

[52] U.S. Cl. ..... 52/729.5; 52/729.2; 52/730.1; 52/731.1; 52/731.7; 52/737.4; 52/738.1; 52/309.9; 52/309.16

[58] Field of Search ..... 52/309.1, 309.4, 52/309.7, 309.13, 309.15, 309.16, 720, 727, 729, 730.1, 731.1, 309.8, 309.9, 729.1–729.3, 729.5, 730.2, 730.6, 731.7, 737.4, 738.1

[56] References Cited

U.S. PATENT DOCUMENTS

| | | | |
|---|---|---|---|
| 866,940 | 9/1907 | Lipman | 52/729 |
| 1,113,555 | 10/1914 | Haldeman | 52/596 |
| 1,421,618 | 7/1922 | Thurston | 52/729 |
| 1,648,801 | 11/1927 | Fritz et al. | 52/647 |
| 1,706,524 | 3/1929 | Farr | 52/727 |
| 2,836,529 | 5/1958 | Morris | 52/309.16 |
| 2,855,021 | 10/1958 | Hoppe | 264/135 |
| 2,870,793 | 1/1959 | Bailey | 52/727 |
| 3,562,403 | 3/1971 | Monahan et al. | 52/515 |
| 3,913,290 | 10/1975 | Billing et al. | 52/729 |
| 3,922,828 | 12/1975 | Patton | 52/727 X |

FOREIGN PATENT DOCUMENTS

| | | | |
|---|---|---|---|
| 551262 | 1/1923 | France | 52/725 |

OTHER PUBLICATIONS

Lewen Publication, p. 14 dated Nov. 26, 1912.

*Primary Examiner*—Robert J. Canfield

[57] ABSTRACT

An elongate construction element according to the invention is made of plastic which has a first, low modulus of elasticity, and a lamination of a material which has a second, significantly higher modulus of elasticity inside the construction element. The construction element has at least one system plane along which the construction element has essentially homogeneous characteristics and is essentially homogeneously constructed. The lamination lies on both sides of the system plane and crosses through the latter at least at one point. The cross-sectional areas of the lamination and the plastic are inversely proportional functions of the effective moduli of elasticity of the plastic and of the lamination so that the flexural rigidities of the cross-sectional areas are essentially equal. The lamination is at least essentially continuous.

74 Claims, 5 Drawing Sheets

Fig.11
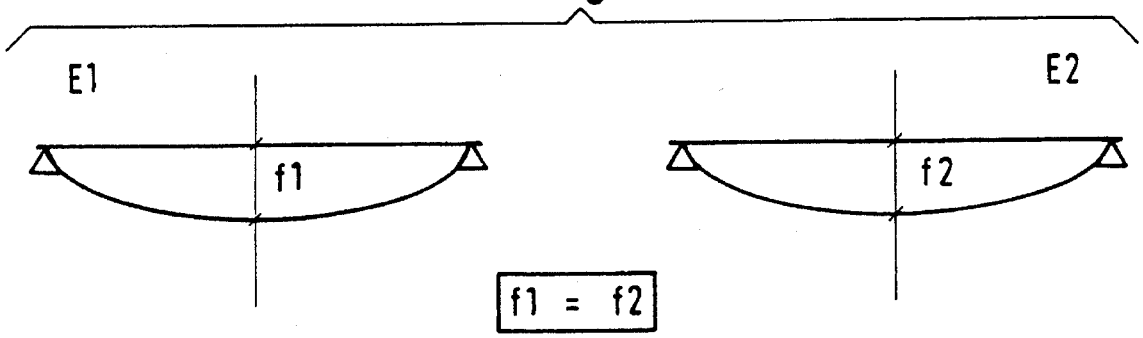
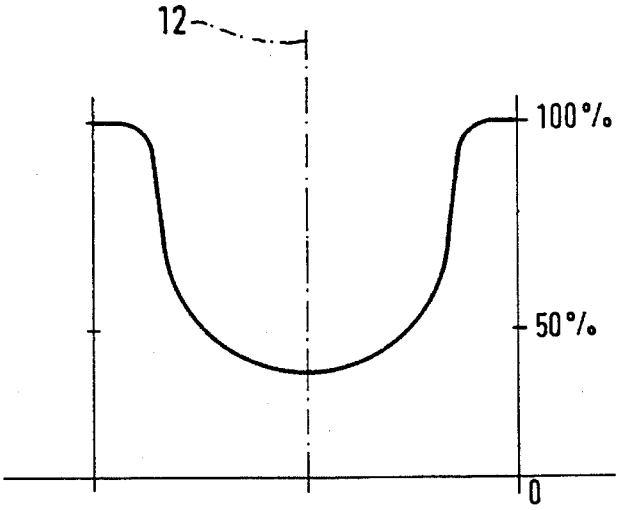
Fig. 12

CONSTRUCTION ELEMENT

BACKGROUND OF THE INVENTION

The invention relates to an elongate construction element. Such construction elements are used frequently, but not exclusively, in the construction industry. Reference may be made, for example, to timber formwork girders, such as are used for example for supporting formwork sheets in floor formwork. They are of I-section, that is to say have two outer webs, which extend perpendicularly to the system plane, as well as one inner web. The lengths lie in the range of about 2.5 m–6 m. They weigh 5–6 kg/m, have an allowable moment in the range of 5 KNm and an allowable transverse force of 11 KN. The widths are around 8 cm and the heights in the range of 16–20 cm. These timber girders are suitable for static loads. Wood is typically not suitable for accepting dynamic loads. Metal is used for accepting dynamic loads. The known timber formwork girders are at least partly glued from laminated wood. This entails a whole series of disadvantages: wood is expensive and less and less available. On the other hand, many are glad if plastics scrap is no longer dumped on refuse sites but can be reused. However, the price of virgin plastic is also dropping continually and new mineral oil sources are being discovered all the time, so that it seems that supplies are assured for several centuries. Disposal of the wood poses problems, because it cannot simply be burned on account of its phenolic resin gluing and its impregnation against insect and fungal attack. Also, some refuse sites no longer accept this wood. Such girders have to be nailed, whether it is to join them to the formwork sheets or whether they have to be nailed to the girder forks. The wood may be mechanically damaged during nailing by splitting. The same applies if it is dropped on the construction site. The material is influenced by weathering and water absorption. In spite of great efforts, the allowable moment and the allowable transverse force are low, but the weight high.

The same also applies in principle with respect to boards or sheets of wood, such as for example formwork sheets.

There are also T girders, angle sections, square beams or suchlike construction elements, where the same disadvantages occur.

In addition, elongate construction elements are also used as supports, which are subjected to compression and buckling force, such as for example the supports for such ceiling formwork. Such construction elements are produced nowadays from galvanized steel tubes. Hot galvanizing is expensive and harmful to the environment. It is difficult to verify whether the tubes have been galvanized on the inside. If the tubes are bent, they no longer run one in the other and their disposal is also expensive.

There are also construction elements which, until now, have been sheathed in plastic in order to protect them, for example, against aggressive liquids. In spite of the sheathing, these construction elements have scarcely improved dimensional stability.

SUMMARY OF THE INVENTION

The object of the invention is to provide construction elements which allow, at the very least, timber resources to be conserved, which are themselves recyclable when they come to the end of their useful life, and which lend themselves to the use of polymers, whether in the form of scrap or whether they also become viable in virgin form, for example owing to a fall in price. Furthermore, the intention is also that in many areas no rethinking is required, so that old ancillary equipment can continue to be used in spite of the use of the new construction elements.

This object is achieved according to the invention. An elongate construction element according to the invention is made of plastic which has a first, low modulus of elasticity, and a lamination of a material which has a second, significantly higher modulus of elasticity inside the construction element. The construction element has at least one system plane along which the construction element has essentially homogeneous characteristics and is essentially homogeneously constructed. The lamination lies on both sides of the system plane and crosses through the latter at least at one point. The cross-sectional areas of the lamination and the plastic are inversely proportional functions of the effective moduli of elasticity of the plastic and of the lamination so that the flexural rigidities of the cross-sectional areas are essentially equal. The lamination is at least essentially continuous.

The term "lamination" as used in this specification refers to a layer, sheet or mesh of material.

Construction elements according to the invention may include the following additional advantageous features. The lamination can be of sheet form. The lamination has clearances which are small in relation to the longitudinal and/or transverse extent of the lamination and through which the plastic integrally bonds on both sides of the lamination.

The lamination can be wire mesh. The wire mesh can have a mesh width in the range 1–40 mm, preferably 5–30 mm, in particular 20 mm±40%. The wire has a diameter of 0.3–3 mm, preferably 1 mm±50%.

The lamination can be made of metal and can be a sheet metal mesh. The lamination can be made of aluminum, bronze, copper, or steel.

The lamination can be coil material, extruded material, or a fiber-reinforced mat.

The lamination can be the same thickness everywhere, or multi-layered, and have, a smaller cross-section in less-loaded regions than in more-loaded regions.

An adhesion promoter layer with respect to the plastic can be on the metal.

The common area center of gravity and/or mass center of gravity of a cross-section of plastic and lamination can be common within tolerance, or the plastic and the lamination have for prestressing purposes an area center of gravity and/or mass center of gravity lying at different points.

The lamination is folded, multiply if appropriate in regions of correspondingly greater stress. The lamination undulates about the system plane. The lamination undulates the same number of times to both directions of the system plane. The folding takes place over a large radius. The lamination has preferred directions in itself. The preferred directions may run at 45°±30%. The preferred directions are determined by the mesh structure.

There can be a hole in the middle region of the mesh. The hole is a through-hole.

The plastic and the lamination can be nailed manually with a hammer and construction nails, at least similarly to wood. The plastic and the lamination can be sawed by construction saws, at least similarly to wood.

The construction element can be injection-molded, or extruded.

The lamination is of a thickness in the range from a few tenths of a millimeter to a few millimeters.

The construction element can be covered at least partly with a thin sheath of high-grade polymer, which is reinforced. The polymer can be a thermoplastic and/or a thermoset plastic. The sheath can have, at least in certain regions, a high friction coefficient. The sheath also can have, at least partly, a friction-enhancing profile. The sheath, at least in certain areas, can be filled with friction-enhancing material such as quartz sand, quartz powder or protruding fibers.

The wall of plastic can be at least partly foamed, and have a density increasing toward the outside. The wall can be solid in its outer region.

In the case of an I girder, the lamination can be metal and profiled in such a way that there is more cross-sectional area in the two outer webs than in the inner web. The lamination can be profiled in the outer webs to form a box section which, in reduced form, at least essentially imitates the outline of the outer webs. The box section can meander in the joining region between outer web and inner web.

The construction element can be a board, a formwork panel for element formwork, a T-section, a beam, a V-section, a circular section, or a tube section.

The plastic of the wall can be filled. The filling material can be non-magnetic, lightweight metal, in particular aluminum. The filling material can be metal chips, turned chips, or foil strips of metal. The foil stirps can be coated with plastic, at least on one side.

DESCRIPTION OF THE DRAWINGS

The invention is now described with reference to preferred illustrative embodiments. In the drawings:

FIG. 11 shows a graphical representation to explain the operating principle of the invention, FIG. 12 shows a curve representing the variation over the cross-section which indicates qualitatively the ratio of plastic material to cavities.

DETAILED DESCRIPTION

Figure 1:
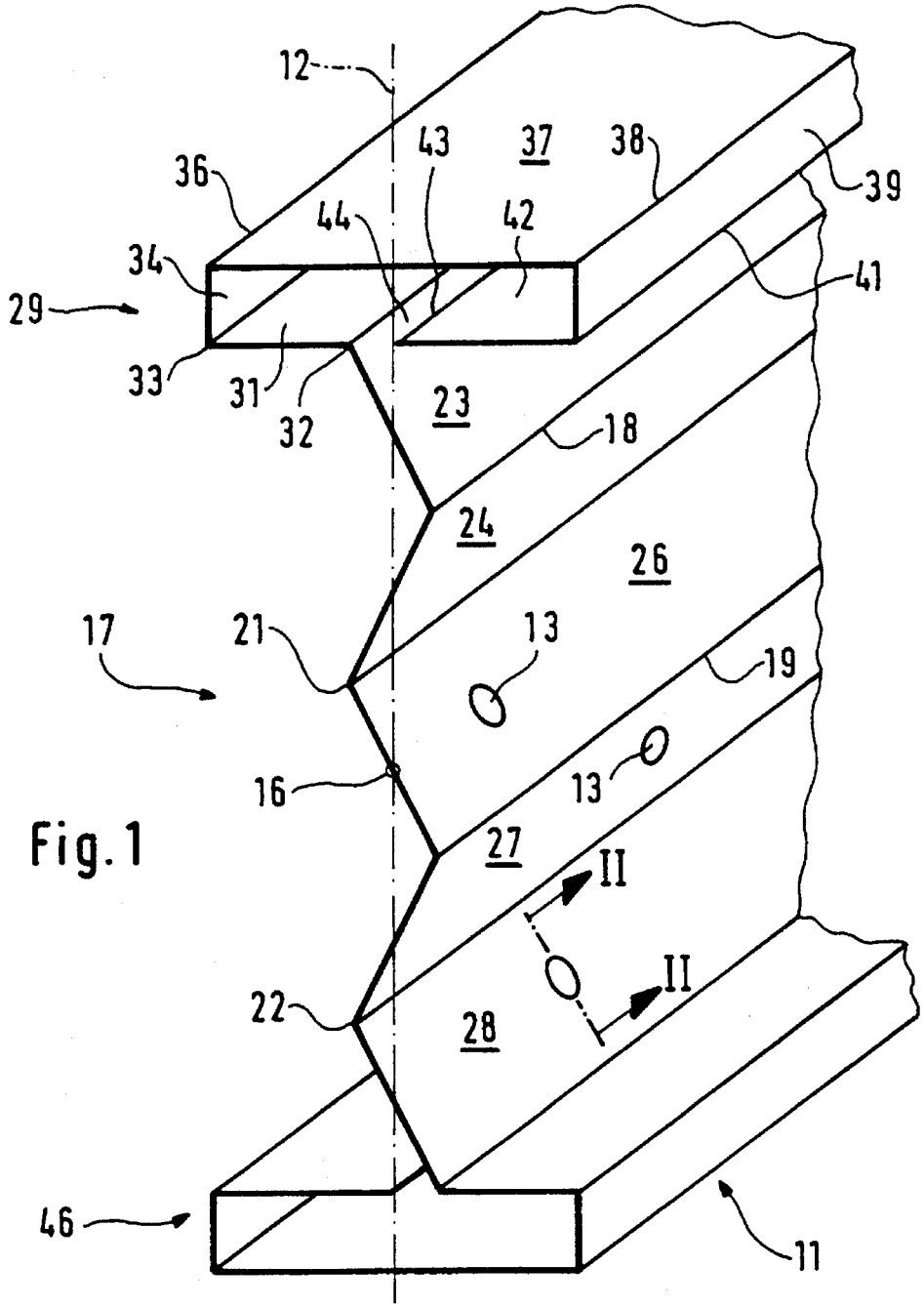
FIG. 1 shows a simplified representation of a layer, as can be used for the production of I girders.
Figure 2:
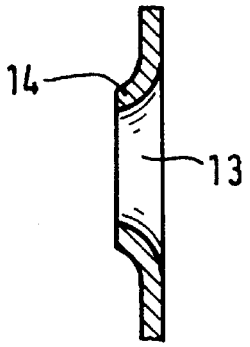
FIG. 2 shows an enlarged, broken away section through a clearance from FIG. 1.

According to FIG. 1, a lamination 11 has a system plane 12. It is continuous and consists of an aluminum alloy of AlMgSi 0.5 of a thickness of 0.8 mm. Aluminum alloy is representative of lightweight metals, or which the lamination can be made. The aluminum sheet comes from a roll of the same width as the lamination 11 when folded flat. In the flat state, this sheet has been punched with a multiplicity of holes 13, which have a burr 14 directed to the left in FIG. 2. Thereafter, the sheet ran through a profiling station and was given there the form which can be seen from FIG. 1. Angled bends are shown there. In reality, however, the edges merge into one another with smooth radii in the range of 2–10 mm, for example 3 mm, 5 mm or 8 mm. The lamination 11 has at the point 16, through which the system plane 12 also passes, both its mass center of gravity and its area center of gravity. From the point 16, the lamination 11 is essentially point-symmetrical. The area center of gravity lies there because the sheet has the same thickness everywhere and the mass center of gravity lies there because the density of the sheet is the same everywhere.

In the middle region 17, the sheet deviates the same number of times and the same distance to the right from the system plane 12, namely twice, and similarly the same distance and the same number of times to the left. Accordingly, there are two right-hand peaks 18, 19 and two left-hand peaks 21, 22. These have the abovementioned radii. On both sides of the peaks there lie flat areas 23, 24, 26, 27, 28.

The area 23 merges at the top into a head region 29, in fact in one piece. The lower, flat area 31 lies to the left of a bend 32, with which the area 23 ends. The area 31 extends to the left significantly beyond the peaks 21, 22 and, in the case of the illustrative embodiment, has a horizontal distance of 32 mm from the peak 18, and also all the peaks 18, 19, 21, 22 have this same horizontal distance from one another. The area 31 merges to the left with a bend 33 of 90° into an area 34 which runs parallel to the system plane 12 and in section is significantly shorter than the area 31. After a bend 36, the area 34 merges into a wide, horizontal area 37, which is perpendicular to the system plane 12, crosses through the latter and extends to the right as far as a bend 38. The horizontal distance between the areas 31 and 37 is 15 mm. With reference to the system plane 12, the peaks 18, 21, 19, 22, as well as the bend 32, are at a distance of 35 mm. The bend 38 lies symmetrically with respect to the bend 36 and is followed mirror-symmetrically with respect to the area 34 by an area 39 and the latter merges on a level with the bend 33 into a 90° bend 41 and lies parallel to the system plane 12. The bend 41 is followed on a level with the area 31 by an area 42, the left-hand edge 43 of which ends in the system plane 12. Between the edge 43 and the bend 32 there lies a small gap 44. According to FIG. 1, the foot region 46 is of a corresponding form. Since the head region 29 has been described precisely, the foot region 46 need not be described in such detail. The lamination 11 according to FIG. 1 could also be turned upside down and would have the same geometrical form.

Figure 3:
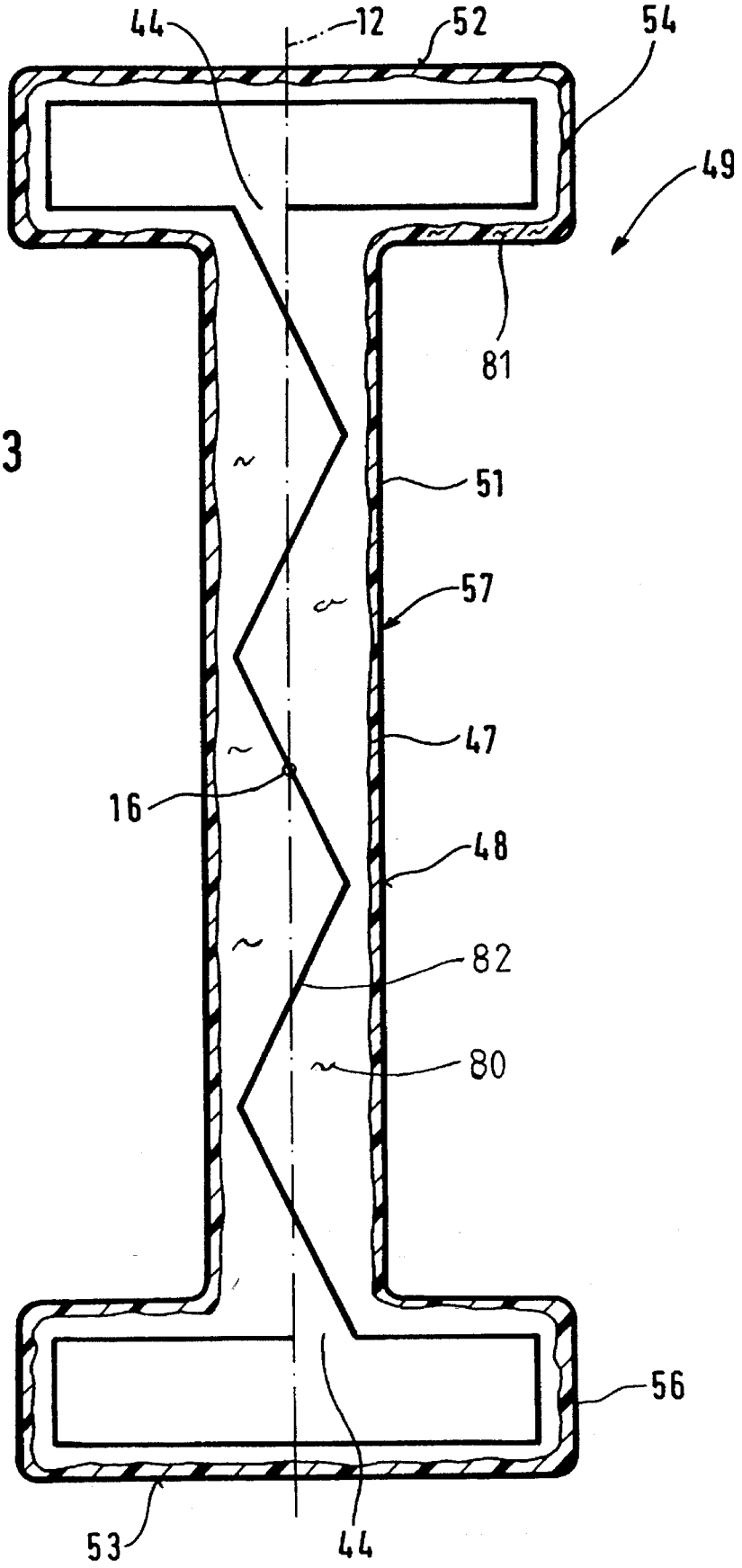
FIG. 3 shows a cross-section through a 20 cm high I girder to scale, as could replace a timber floor girder.

The reason why the lamination 11 consists of aluminum is that aluminum is easily nailed and its oxide layer 82 readily bonds with good adhesion to the plastic 47 from FIG. 3. For this reason, it is also possible, if appropriate, to omit the holes 13, which after all allow material bridges. But also the saws usually used on a construction site are not blunted by aluminum. No special saw blades, for example carbide-tipped saw blades, are required. Depending on the plastic 47 and depending on whether it is used filled or unfilled, it has a certain modulus of elasticity. If polyethylene is used as plastic, it has a modulus of elasticity of, for example, 500–2000 N/mm$^2$. If it is filled, it has a modulus of elasticity of, for example, 3,000–8,000 N/mm$^2$. Aluminum has, for example, 70,000 N/mm$^2$ and, under such conditions, and with the dimensions which can be seen from FIG. 3, the aluminum sheet can be 0.8 mm thick. If the lamination 11 were of sheet steel, the modulus of elasticity would be 210,000 N/mm$^2$ and the lamination would have to be correspondingly thinner. If the lamination is of a glass fiber mat, the modulus of elasticity of which is, for example, 35,000 N/mm$^2$, the lamination 11 would have to be thicker. Mats which use carbon fibers have a modulus of elasticity of 100,000–120,000 N/mm$^2$ and the lamination 11 could thus be correspondingly thinner than in the case of aluminum.

The structure according to FIG. 1 is produced continuously. Depending on the length of the sheet coil, lengths can be produced, for example 5,000–6,000 m. The structure according to FIG. 1 is fed to an extruder, to be precise a twin-screw extruder. The latter forces the plastic into a calibrating section, which has a circumference 48 according to FIG. 3, that is to say according to the shape of the I girder 49 to be produced. The plastic 47 is sheathed by a high-grade outer lamination 51. The latter is a polymer which is pore-free on the outside and denser than the inner plastic 47. The sheath can be reinforced with metal chips 81. The polymer can be a thermoplastic and/or a thermoset plastic. The sheath has, at least in certain regions, a high friction coefficient. The sheath also has, at least partly, a friction-enhancing profile. The sheath, at least in certain areas, is filled with friction-enhancing material, such as quartz sand, quartz powder, or protruding fibers. The outer lamination 51 protects the plastic 47 against damage and provides additional mechanical strength. Its mass and area center of gravity also lies at the point 16—within wanted or unwanted tolerances. The plastic 47 is foamed according to FIG. 12, that is to say in the system plane 12 there is 50% material and the rest is cavity. The density then symmetrically increases toward the outside and then reaches 100% in each case in the outer areas. The outer lamination 51 can be applied by the coextrusion process either separately or else produced as a so-called fat layer by the plastic being pressed with increased pressure into the profiling section. The plastic 47 is filled, to be precise with metal chips 80, preferably of non-magnetic material, such as aluminum, magnesium, non-magnetic steel material. These chips may be generated during production in metalworks. For example during turning, planing, milling, grinding. If this type of chip production is not adequate, chips may also be produced especially for the invention. Of course, the chips must be free from oil, drilling lubricant or the like. Strips of shredded drink cans of aluminum have also proved to be successful, the usually provided coating of the cans being beneficial for the present case. Furthermore, thinner foils may also be used, namely lametta-like aluminum, which is generated in large quantities as scrap in the packaging industry, for example where bacteria-free, sterile packages are produced, or where it is wished to make plastic water-impermeable by the aluminum layer. These foils also do not need to be pretreated, because they are after all coated with plastic and thus provide an aluminum/plastic adhesion bridge.

Since the outer lamination 51 can itself be mirror-smooth, it is roughened, at least if such I girders 49 are to be produced with the invention. This can be performed by roughening its upper side 52 and also its under side 53 by profiling. This can be performed by allowing profiling rollers to run along with it after the profiling section and before the outer lamination 51 is cold. It can, however, also be performed by filling the outer lamination 51, for example with quartz particles, so that it becomes rough.

The gap 44 allows material to be able to flow into the head region 29 and the foot region 46. Since the edge 43 ends in the system plane 12, it ends at a favorable location for this in terms of loading.

Under normal circumstances, the lamination 11 would buckle under loading. It would be much too thin to retain its geometry of its own accord under loading. This buckling, in which in fact specifically small forces occur, at least at the beginning, can be reliably prevented by the plastic 47. FIG. 3 reveals that the lamination 11 is always at a distance from the circumference 48, that is to say always has sufficient material around it to prevent this buckling. However, it does not matter if the lamination 11 is exposed at individual points. In FIG. 3 also, the individual zones of the lamination 11 merge into one another with angled radii. However, comparatively large radii are preferred.

The mass and area center of gravity of the plastic 47 likewise lies at the point 16. In the usual way, the I girder 49 has two outer webs 54, 56 and a joining web 57, joining the two said outer webs. The webs are symmetrical to the system plane 12, but also symmetrical to a plane not shown which is perpendicular to the system plane 12 and passes through the point 16. The I girder 49 preferably has precisely the same outline form as the previous girders consisting of wood, so that in this respect neither redesigns nor rethinking are required.

There are holes 13 not only in the middle region 17. In particular, they are provided in the head region 29 and in the foot region 46, even if they are not shown. The plastic 47 can expand freely through these holes into the two outer webs 54, 56 and also penetrate there, so that a construction according to FIG. 3 is obtained. This can also be used to control how the density of the plastic is in the two outer webs 54, 56. The less holes there are, the more solid the plastic is in the outer webs 54, 56, which after all have to accept in particular the shear stresses and tensile stresses.

Figure 4:
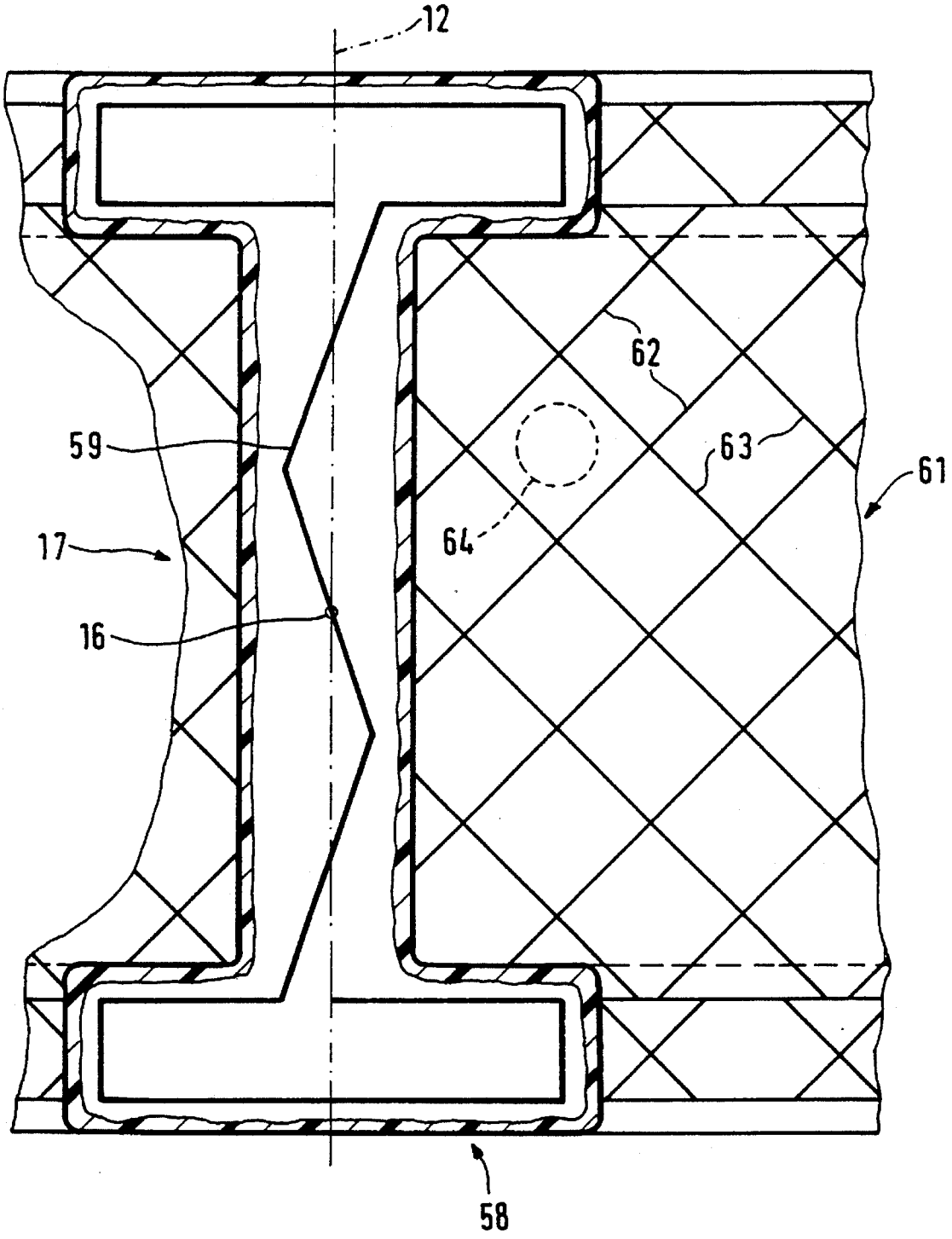
FIG. 4 shows a cross-section through a construction element similar to FIG. 3, the girder being 16 cm high and a supporting grid being used instead of the sheet material according to FIG. 1.

According to the illustrative embodiment of FIG. 4, the I girder 58 is 16 cm high. Its other dimensions can be derived from this, since FIG. 4 is to scale. And here too, the point 16 and the system plane 12 again have the same characteristics as in the case of the first illustrative embodiment. Since the I girder 58 is lower than the I girder 49, the middle region 17 deviates only once to the left and then once to the right. As a variant, instead of sheet metal for the lamination 59, a wire mesh 61 is used, which is bent into a formation analogous to FIG. 1 and then coextruded. The wires 62 run at 45° to the longitudinal extent of the I girder 58 from top right to bottom left. The wires 63 perpendicular thereto likewise run at 45°, but in the other direction. These angle dimensions relate of course to the middle region. The positions in the outer webs are then obtained from them. Wire mesh 61 has the advantage that it is even cheaper than sheet metal. The plastic can expand freely. It is possible here to provide through-holes 64 in the middle region 17, one of which is shown by a dashed line. The through-holes 64 must not cut through the wires 62, 63 and there must be a sufficient distance from the edge of the through-hole 64 to the wire 62, 63 that the wire 62, 63 cannot buckle. In this case, the wire 62, 63 can transfer not only tensile forces, which it can anyway, but also in some cases shear forces.

Figure 5:
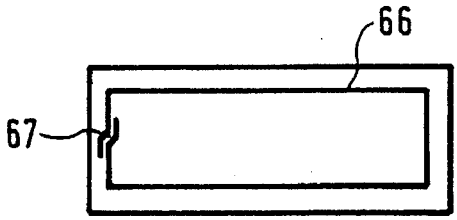
FIG. 5 shows a systematic cross-section through a board, the side/height ratio being = or <10.

FIG. 5 shows that a board can be produced according to the invention by the lamination being shaped to form a box-shaped inner section 66, which overlaps at an overlap point 67. This overlap point 67 must be large enough that the plastic is loaded only to the extent of its specific loadability. If the moduli of elasticity of the two materials is very different, the overlap point 67 must be large in area. If the inner section 66 is of sheet metal, a greater number of holes must be provided in order that the plastic can both penetrate into the inner section 66 and can expand out of it. Here too, the inner section 66 has large radii in the corners.

Figure 6:
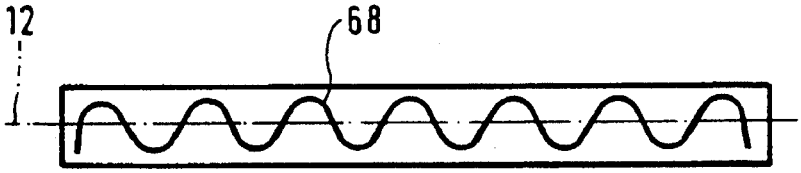
FIG. 6 shows a diagrammatic cross-section through a sheet, the side/height ratio being, for example, >10.

FIG. 6 shows how a board or a sheet can be produced, whereas FIG. 5 indicates rather the production of a square beam. According to FIG. 6, the system plane 12 is as shown. A lamination 68 undulates about it in the form of corrugated sheet.

Figure 7:
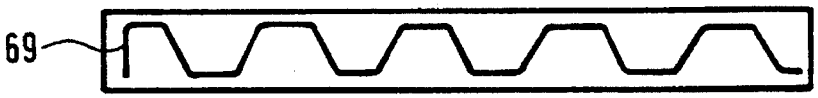
FIG. 7 shows a cross-section like FIG. 6, but with a different layer.

In FIG. 7, this lamination 69 is trapezoidal with rounded-off edges. In FIG. 6 and 7, the ends of the lamination 68, 69 run essentially parallel to the side areas of these components.

Figure 8:
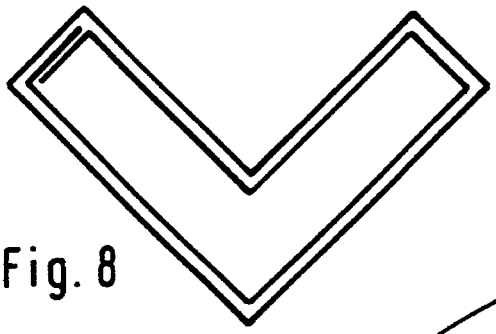
FIG. 8 shows a diagrammatic cross-section through an angle section.
Figure 9:
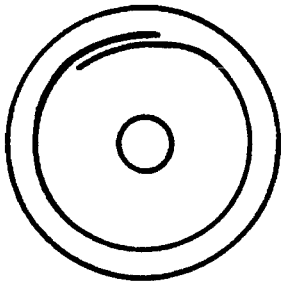
FIG. 9 shows a diagrammatic cross-section through a circle, or tube section.

In analogy with FIG. 5, FIG. 8 shows an angle section and FIG. 9 a tube section.

Figure 10:
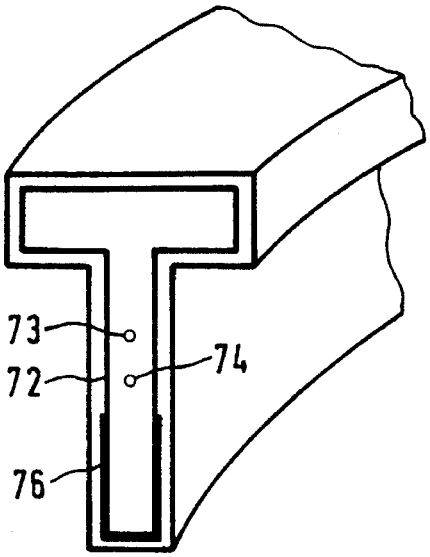
FIG. 10 shows a diagrammatic cross-section through a T section.

FIG. 10 shows that the plastic and the lamination do not always have to have a common mass/area center of gravity. Here a T girder 71 of known outline form can be seen, having the same plastic lamination construction as in the case of the other illustrative embodiments. The lamination 72 runs as a diminished T within the T girder 71. Here, the plastic has a mass/area center of gravity 73 and the associated point 74 is further down, to be precise because the lamination 72 is thicker in its lower region 76, in a U-shaped configuration, than at the top. Therefore, the point 74 is lower down than the point 73 and the T girder 71 has an upwardly directed curvature, as the outlines show. It is in this position when unloaded and then goes down under loading, for example to the extent that it runs in a straight line. The thickening in the lower region 76 can be produced, for example, by producing the lamination 72 in an aluminum extrusion process. The die then has a wider slot in the lower region 76 than at the top. In the sheet metal technique or wire grid technique, however, it is also possible to push a U-section onto the upright limb of the lamination 72 from below, so that the layer is doubled here. This pushed-on lamination is then to be joined firmly to the other lamination. In FIG. 11, the lamination 11, but also the other laminations, is represented on the left as a girder which has two bearings at its ends.

The same is represented on the right in FIG. 11 for the plastic (filled or unfilled, foamed or unfoamed). For the lamination, the modulus of elasticity E1 on the left applies and, for the plastic, the modulus of elasticity E2 on the right applies. It is ideal if the deflection f1 of the one is equal to the deflection f2 of the other. This also dictates how the areas of the lamination have to be in relation to the plastic. Furthermore, it is necessary that the flexural rigidities (E×1) of the two systems are the same. If this is achieved, each system accepts the same amount of load. In an ideal case, not even any adhesion would be needed between the lamination and the plastic. Since ideal cases cannot be created and may also not be wished to be created, the relative movements which otherwise threaten to take place between the lamination and the plastic must be prevented by integral bonds.

Since the moduli of elasticity are very different, the lamination 11 must always be relatively thin and can consequently be readily nailed and/or sawed, in particular if it is of aluminum.

If the layer is of magnetic material, such a construction element is less suitable for recycling. If the no longer usable construction element is namely reduced, for example granulated, and these grains contain magnetizable material, this produces as it were a multiplicity of small compass needles, which align themselves perpendicularly to the circumference 48, because electric charges are given off in extrusion, but also in an injection-molding process. Otherwise, each construction element can be reduced and provide the basic substance for a new construction element.

The plastic is essentially a thermoplastic, on account of the recyclability. However, thermoset plastic which has been ground very small, for example to form flour, can be incorporated as filling material.

In the case of an I girder according to FIG. 3, an allowable moment of 7.2 KNm and an allowable transverse force of 14.4 KNm can be achieved with a weight of 6 kg/m.

I claim:

1. An elongate construction element, made of plastic which has a first, low modulus of elasticity, and having a lamination of a material which has a second, significantly higher modulus of elasticity inside the construction element, and at least one system plane associated with the construction element, along which plane the construction element has essentially homogeneous characteristics and is essentially homogeneously constructed, comprising the improvement wherein:

a) the lamination lies on both sides of the system plane and crosses through the latter at least at one point;

b) the cross-sectional areas of the lamination and the plastic are inversely proportional functions of the effective moduli of elasticity of the plastic and of the lamination so that the flexural rigidities of the cross-sectional areas are essentially equal and c) the lamination is at least essentially continuous.

2. The construction element as claimed in claim 1, wherein the lamination is of sheet form.

3. The construction element as claimed in claim 2, wherein the lamination has clearances which are small in relation to the longitudinal extent of the lamination and through which the plastic is integrally bonded to both sides of the lamination.

4. The construction element as claimed in claim 1, wherein the lamination is a mesh.

5. The construction element as claimed in claim 4, wherein the lamination is a wire mesh.

6. The construction element as claimed in claim 5, wherein the wire mesh has a mesh width in the range 1–40 mm.

7. The construction element as claimed in claim 5, wherein the wire has a diameter of 0.3–3 mm.

8. The construction element as claimed in claim 4, wherein the lamination is a sheet metal mesh.

9. The construction element as claimed in claim 1, wherein the lamination is metal.

10. The construction element as claimed in claim 9, wherein the lamination is aluminum.

11. The construction element as claimed in claim 9, wherein the lamination is of bronze.

12. The construction element as claimed in claim 9, wherein the lamination is copper.

13. The construction element as claimed in claim 9, wherein the lamination is steel.

14. The construction element as claimed in claim 1, wherein the lamination is coil material.

15. The construction element as claimed in claim 1, wherein the lamination is extruded material.

16. The construction element as claimed in claim 1, wherein the lamination is of a fiber-reinforced mat.

17. The construction element as claimed in claim 1, wherein the lamination is of the same thickness everywhere.

18. The construction element as claimed in claim 1, wherein the lamination is multi-layered.

19. The construction element as claimed in claim 1, wherein the lamination has a smaller cross section in less-loaded regions than in more-loaded regions.

20. The construction element as claimed in claim 9, wherein an adhesion promoter layer with respect to the plastic is on the metal.

21. The construction element as claimed in claim 1, wherein the common area center of gravity and mass center of gravity of a cross section of plastic and lamination are common within tolerance.

22. The construction element as claimed in claim 1, wherein the plastic and the lamination have for prestressing purposes an area center of gravity and a mass center of gravity lying at different points.

23. The construction element as claimed in claim 1, wherein the lamination is folded in regions of correspondingly greater stress.

24. The construction element as claimed in claim 1, wherein the lamination undulates about the system plane.

25. The construction element as claimed in claim 24, wherein the lamination undulates the same number of times to both directions of the system plane.

26. The construction element as claimed in claim 23, wherein the lamination is folded over a large radius.

27. The construction element as claimed in claim 26, wherein the lamination has preferred directions in itself.

28. The construction element as claimed in claim 27, wherein the preferred directions run at 45°±30%.

29. The construction element as claimed in claim 26, wherein the lamination is a mesh and the preferred directions are determined by the mesh structure.

30. The construction element as claimed in claim 4, wherein there is a hole in the middle region of the mesh.

31. The construction element as claimed in claim 30, wherein the hole is a through-hole.

32. The construction element as claimed in claim 1, wherein the plastic and the lamination are nailable manually with a hammer and construction nails, at least similarly to wood.

33. The construction element as claimed in claim 1, wherein the plastic and the lamination are sawable by construction saws, at least similarly to wood.

34. The construction element as claimed in claim 1, wherein the construction element is injection-molded.

35. The construction element as claimed in claim 1, wherein the construction element is extruded.

36. The construction element as claimed in claim 1, wherein the lamination is of a thickness in the range from a few tenths of a millimeter to a few millimeters.

37. The construction element as claimed in claim 1, wherein the construction element is covered at least partly with a thin sheath of high-grade polymer.

38. The construction element as claimed in claim 37, wherein the sheath is reinforced.

39. The construction element as claimed in claim 37, wherein the polymer is selected from a thermoplastic and a thermoset plastic.

40. The construction element as claimed in claim 37, wherein the sheath has, at least in certain regions, a high friction coefficient.

41. The construction element as claimed in claim 40, wherein the sheath has, at least partly, a friction-enhancing profile.

42. The construction element as claimed in claim 40, wherein the sheath is, at least in certain areas, filled with friction-enhancing material.

43. The construction element as claimed in claim 1, wherein the plastic is at least partly foamed.

44. The construction element as claimed in claim 43, wherein the plastic has a density increasing toward the outside of the construction element.

45. The construction element as claimed in claim 44, wherein the construction element is solid in its outer region.

46. The construction element as claimed in claim 1, wherein the construction element is an I girder, the lamination is metal and is profiled in such a way that there is more cross-sectional area in the two outer webs than in the inner web.

47. The construction element as claimed in claim 46, wherein the lamination is profiled in the outer webs to form a box section which, in reduced form, at least essentially imitates the outline of the outer webs.

48. The construction element as claimed in claim 47, wherein the box section meanders in the joining region between outer web and inner web.

49. The construction element as claimed in claim 1, wherein the construction element is a board.

50. The construction element as claimed in claim 49, wherein the construction element is a formwork panel for element formwork.

51. The construction element as claimed in claim 1, wherein the construction element is a T-section.

52. The construction element as claimed in claim 1, wherein the construction element is a beam.

53. The construction element as claimed in claim 1, wherein the construction element is a V-section.

54. The construction element as claimed in claim 1, wherein the construction element is a circular section.

55. The construction element as claimed in claim 54, wherein, the construction element is a tube section.

56. The construction element as claimed in claim 1, wherein the plastic is filled with reinforcing filling material.

57. The construction element as claimed in claim 56, wherein the filling material is non-magnetic.

58. The construction element as claimed in claim 56, wherein the filling material is metal chips.

59. The construction element as claimed in claim 58, wherein the metal chips are turned chips.

60. The construction element as claimed in claim 57, wherein the filling material is foil strips of metal.

61. The construction element as claimed in claim 60, wherein the foil strips are coated with plastic, at least on one side.

62. The construction element as claimed in claim 56, wherein the filling material is lightweight metal.

63. The construction element according to claim 5, wherein the wire has a diameter of 1 mm±50%.

64. The construction element according to claim 1, wherein the lamination is folded multiply in regions of correspondingly greater stress.

65. The construction element according to claim 42, wherein the friction-enhancing material is selected from quartz sand, quartz powder and protruding fibers.

66. The construction element according to claim 62, wherein the filling material is aluminum.

67. The construction element as claimed in claim 2, wherein the lamination has clearances which are small in relation to the longitudinal and transverse extent of the lamination and through which the plastic is integrally bonded to both sides of the lamination.

68. The construction element as claimed in claim 2, wherein the lamination has clearances which are small in relation to the transverse extent of the lamination and through which the plastic is integrally bonded to both sides of the lamination.

69. The construction element as claimed in claim 9, wherein the lamination is of a thickness in the range from a few tenths of a millimeter to a few millimeters.

70. The construction element as claimed in claim 9, wherein the lamination is an aluminum alloy.

71. The construction element as claimed in claim 1, wherein the common area center of gravity of a cross section of plastic and lamination is common within tolerance.

72. The construction element as claimed in claim 1, wherein the mass center of gravity of a cross section of plastic and lamination is common within tolerance.

73. The construction element as claimed in claim 1, wherein the plastic and the lamination have for prestressing purposes an area center of gravity lying at different points.

74. The construction element as claimed in claim 1, wherein the plastic and the lamination have for prestressing purposes a mass center of gravity lying at different points.

* * * * *